US006962123B1

(12) United States Patent
Tunks

(10) Patent No.: US 6,962,123 B1
(45) Date of Patent: Nov. 8, 2005

(54) UNDERWATER MANEUVERING DEVICE

(76) Inventor: Timothy E. Tunks, P.O. Box 12047, Marina del Rey, CA (US) 90295

( * ) Notice: Subject to any disclaimer, the term of this patent is extended or adjusted under 35 U.S.C. 154(b) by 0 days.

(21) Appl. No.: 09/856,113

(22) PCT Filed: Sep. 19, 2000

(86) PCT No.: PCT/US00/25887

§ 371 (c)(1),
(2), (4) Date: Apr. 13, 2002

(87) PCT Pub. No.: WO01/21477

PCT Pub. Date: Mar. 29, 2001

Related U.S. Application Data

(60) Provisional application No. 60/154,733, filed on Sep. 20, 1999.

(51) Int. Cl.[7] ..... B63C 11/46

(52) U.S. Cl. ..... 114/315; 114/244; 114/253

(58) Field of Search ..... 114/244, 253, 114/315

(56) References Cited

U.S. PATENT DOCUMENTS

| | | | | | |
|---|---|---|---|---|---|
| 4,207,829 | A | * | 6/1980 | Meister et al. | 114/245 |
| 4,813,367 | A | * | 3/1989 | Stevenson | 114/315 |
| 5,482,485 | A | * | 1/1996 | Ball | 441/65 |
| 5,819,680 | A | * | 10/1998 | Haller et al. | 114/253 |

* cited by examiner

*Primary Examiner*—Ed Swinehart
(74) *Attorney, Agent, or Firm*—George W. Finch

(57) ABSTRACT

An underwater maneuvering device is disclosed. It utilizes a horizontal planar member, a perpendicularly disposed fin member, hand grip portions, and a towing bridle, pulley and towline assembly that permit the device to freely change its angular alignment to the towline for diving, turning and surfacing maneuvers. The arrangement of the members and hand grip portions permit gripping thereof by the diver so that the drag forces of the diver input the forces needed to control the device, requiring little or no additional effort on the part of the diver. The device may be constructed to disassemble for easy transport and storage.

39 Claims, 9 Drawing Sheets

UNDERWATER MANEUVERING DEVICE

This application is a 371 of PCT/US00/25887, filed Sep. 19, 2000, which claims the benefit of provisional application 60/154,773 filed Sep. 20, 1999.

TECHNICAL FIELD

The present invention generally relates to an aquatic maneuvering device, more specifically to an improved maneuvering device for use on and under the water whenever the user is being propelled through the water by auxiliary means such as a tow boat or jet ski, mechanical cable, or by the propulsion effects of water current.

BACKGROUND ART

Water-borne activities are extremely popular. Such activities take place in rivers, lakes, oceans and just about anywhere a suitable body of water can be found. These activities include those performed both under and above the water surface. People spend a lot of time engaged in underwater activities. These activities include underwater survey, scallop and clam searching, spear fishing, sand dollar harvesting, sightseeing, photography, acrobatic play, etc. Typically, a person engaged in underwater activities wears a mask and either scuba diving equipment or a snorkel. The scuba diving equipment permits a person to stay underwater for an extended period of time while a snorkel is easy to use, requires little training and does not present the risks that occur with scuba gear.

People engaged in underwater activities want to maneuver easily. For instance, when a clam bed is seen off to one side, the person will want to get there quickly. Underwater maneuvering devices are very handy to such a person. Underwater maneuvering devices generally come in two types, underwater propulsion vehicles which are motorized propeller driven craft and are generally battery-powered, and passive underwater maneuvering devices such as towed by a boat to provide a user directional control while underwater.

Passive aquatic maneuvering devices are known in the art. One example of these prior inventions is found in U.S. Pat. No. 4,149,483 by Scott, Jr. The Scott, Jr. device is a relatively large flat body member with a submerging and surfacing vane, as well as rolling vanes. Complex bevel gear controlled handgrips provide the necessary movement to the particular vanes. The device permits a user to surface and submerge with relative ease. Furthermore, a user can roll or partially roll the device and himself. U.S. Pat. No. 5,134,955 by Manfield discloses a two-person underwater sled similar to the Scott device. While the Scott device provides substantial vertical directional control for a user, it has many moving parts, and appears to be relatively complex and expensive to manufacture. Its twin hand controls require substantial coordination and skill for proper use. Furthermore, the twin non-centered controls require the user to use both hands for proper control. The user lacks a free hand for such activities such as scallop harvesting or photography. The Scott device also lacks the ability to provide substantial horizontal directional control.

U.S. Pat. No. 5,482,485 by Ball discloses an underwater maneuvering device that is unnecessarily large and bulky. The base member is much larger than is required for all but the most buoyant of divers, and there are two vertical fins adding to the complexity of its manufacture. It provides only limited one hand maneuverability, which impedes nostril pinching for middle ear pressure equalization as well as other activities discussed above.

DISCLOSURE OF INVENTION

The present invention is an underwater maneuvering device. It includes a dive plane with a centrally located fin extending above and below the dive plane. The fin may be removable from the dive plane so that the device can be disassembled for easy storage and transport or the device may be constructed as a unitary structure. A towing bridle is attached at spaced locations on either the dive plane or fin. The bridle includes a single sheave pulley for attachment to a tow line normally pulled slowly by a boat or other propulsion device. The propulsion device may be water borne, a mechanical cable overhead or submerged, or a static anchor point if the device is used in waters with current or tidal flow. The bridle is led through the sheave to provide full freedom of angular movement in either the horizontal or vertical plane, depending on the attachments of the bridle. A hand grip, which extends in a vertical plane from the upper portion to the lower portion of the fin, provides vertical directional control. The hand grip may be a flexible dive tether or a rigid bar, or both may be present. The device is usually fitted with a second horizontal tether attached at the ends or spaced locations at the trailing edge of the dive plane. When the user's grip is moved upwardly or downwardly along the dive tether or the rigid bar, the device will either angle down for diving or up for surfacing. The horizontal tether provides for angular control of the vertical fin for left and right control, which is achieved by moving one's grip either to the left or the right. If the horizontal tether is not present, the user just grabs the end tip of the dive plane for horizontal directional control. However, in actuality, users wearing swim fins tend to rotate into banks to turn, so that vertical and horizontal become relative terms and the horizontal tether is needed only for abrupt turns.

Therefore, although the present invention may be "flown" by a user with both hands, it also can be controlled with a one handed grip of the dive tether and the horizontal tether. Since the tethers normally trail behind the device to a location behind the rigid bar, one handed capability greatly enhances the user's euphoric sense of control, the user's field of vision, as well as the efficiency of the dive plane and fin, for then they are well ahead of any disturbed water flow caused by the user's turbulence. One handed operation also allows underwater photography with simple cameras and nostril pinching for the purpose of middle ear pressure equalization.

Therefore, it is an object of the present invention to provide for an underwater maneuvering device that can provide horizontal and vertical directional control even in the hands of an unskilled user.

Another object is to provide for an underwater maneuvering device that can be operated with one hand.

Another object is to provide for an underwater maneuvering device that can be quickly disassembled for easy storage and transport.

Another object is to provide for an underwater maneuvering device that does not require substantial arm or body strength to operate.

Another object is to provide for an underwater maneuvering device that is of simple construction and is easy to maintain.

Another object is to provide an underwater maneuvering device that is visually appealing to excite the user and stimulate sales.

It is a final object of the present invention to provide a fun and empowering experience to the user because of the ease and naturalness of control, as well as greatly increasing a user's range of motion through the water.

These other objects and advantages of the present invention will become apparent to those skilled in the art after considering the following detailed specification together with the accompanying drawings wherein:

BEST MODES FOR CARRYING OUT THE INVENTION

Figure 1:
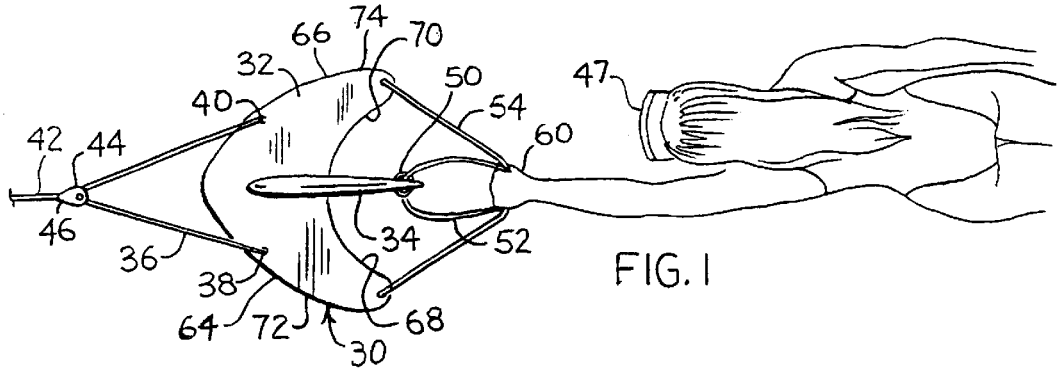
FIG. 1 is a plan view of the present invention showing the relationship between the user, the dive plane and fin, the tow bridle, the tow bridal pulley, and the tow line.

Referring to the drawings, more particularly by reference numbers, number 30 in FIG. 1 refers to a towed, underwater maneuvering device. The device 30, as shown, includes a dive plane 32, a fin 34 connected at right angles thereto, and a bridle 36 connected, in embodiment 30, at spaced locations 38 and 40 on the dive plane 32. The bridle 36 is attached to a tow line 42 preferably by some sort of low friction means, such as the single sheave pulley 44 shown. Even though the pulley 44 can include a swivel 46, if the tow line 42 is braided line rather than twisted rope, swivel 46 is not really needed unless the device is used acrobatically, including a series of rolls in the same direction, or the tow line 42 is deployed with an initial twist. Twisted line is not recommended as such tends to unwind with an increasing load which may cause tangles when abruptly unloaded even though a swivel 46 is present.

The tow line 42 is used to pull the device 30 through the water at relatively low speeds, usually less than 5 knots. Wearing a swim mask 47, a user 48 holds onto the device 30 either by a rigid bar 50 or a vertical tether 52, both of which being attached to the fin 34. Although the rigid bar is normally used for pitch changes, when the user is wearing swim fins 53, the user 48 can twist and apply rolling torque to the rigid bar 50 using both hands. In addition, the device 30 may include a horizontal tether 54 connected at spaced locations 56 and 58 horizontally to the dive plane 32. The user 48 may use one hand 60 to hold on to the device 30, as shown in FIG. 1, or may hold on to the rigid bar 50 or vertical tether 52 with one hand 60 and steer the device 30 by gripping the horizontal tether 54 with the other hand 62.

As can be seen in FIG. 1, the bridle attach points 38 and 40 are adjacent the leading edges 64 and 66 of the dive plane 32, whereas the horizontal tether 54 is connected to the trailing edges 68 and 70 of the dive plane 32 adjacent or at its end tips 72 and 74. If the device 30 is being towed too fast, the user 48 may be unable to hold on and/or the user's swim mask 47 may be swept out of position on the user's face.

Figure 2:
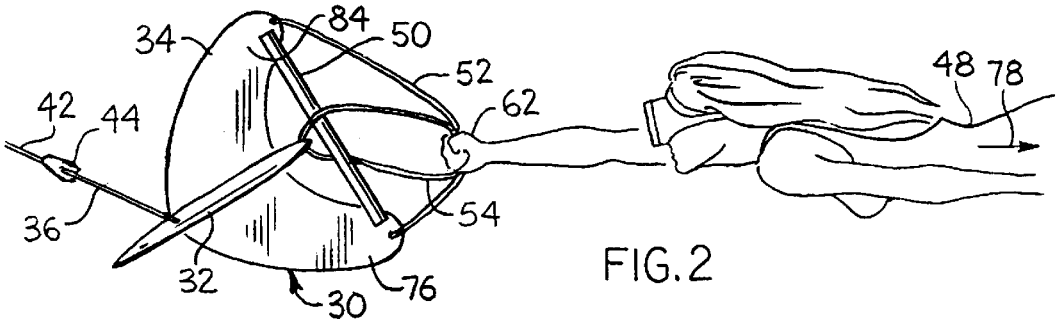
FIG. 2 is a side view of the present invention being controlled b tethers showing a dive attitude.

FIG. 2 illustrates how a user 48 can cause the device 30 to dive using the tethers 52 and 54. In FIG. 2, the user's hand 62 is centered on the tether 54, but toward the lower fin portion 76 on tether 52. The drag 78 of the user 48 causes the dive plane 32 of the device 30 to acquire a negative angle of attack 80 with respect to the pull 82 on the tow line 42. The descent caused thereby continues until the user's drag 78 can no longer overcome the upward pull 82 on the tow line 42, at which time no further descent will occur. The percentage of vertical tether 52, which is also attached to the upper fin portion 84, versus the portion of the tether 52 below the hand 62 determines the rate of descent for any particular tow line angle.

Figure 3:
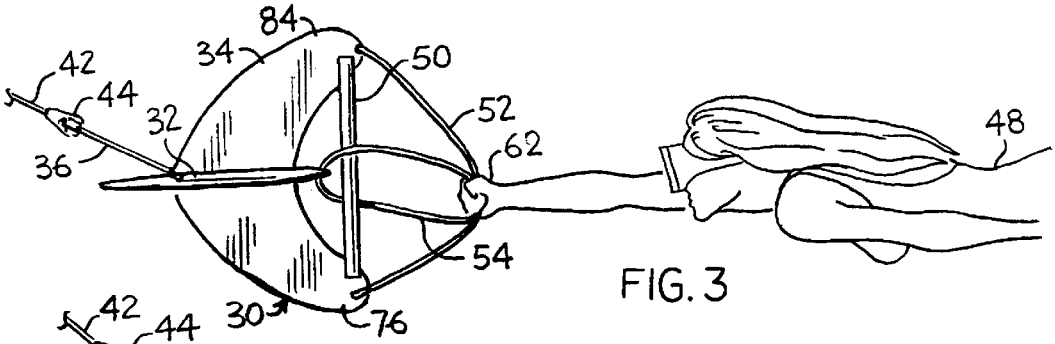
FIG. 3 is a side view of the present invention being controlled by the tethers showing a level attitude.

In FIG. 3, the user 48 has achieved a neutral angle on the dive plane 32 by gripping the tether 52 at almost its exact center between the upper and lower portions 84 and 76 of the fin 34. As explained previously, the exact neutral angle, wherein the dive plane 32 maintains the elevation of the user 48 is a relationship between the length of the tow line 42 and the depth and drag of the user 48.

Figure 4:
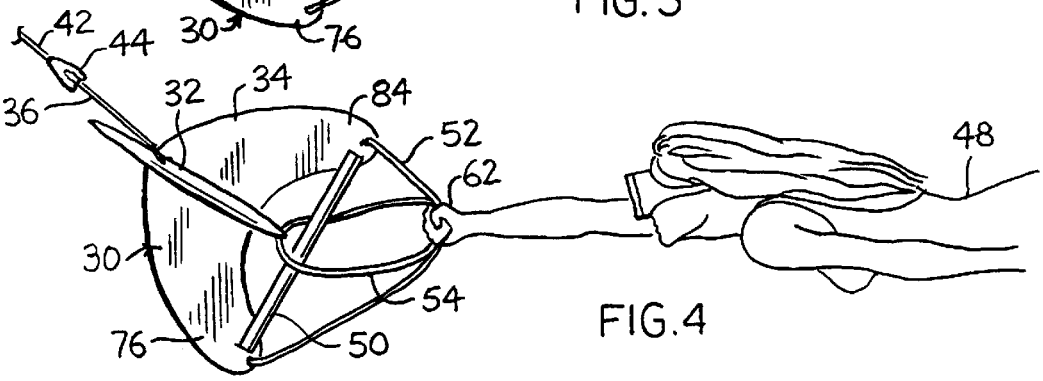
FIG. 4 is a side view of the present invention being controlled by the tethers showing a surfacing attitude.

FIG. 4 illustrates the user 48 holding onto the tether 52 closer to the upper portion 84 of the fin 34 than the lower portion 76 to ascend by angling the dive plane 32 toward the surface 86.

Figure 5:
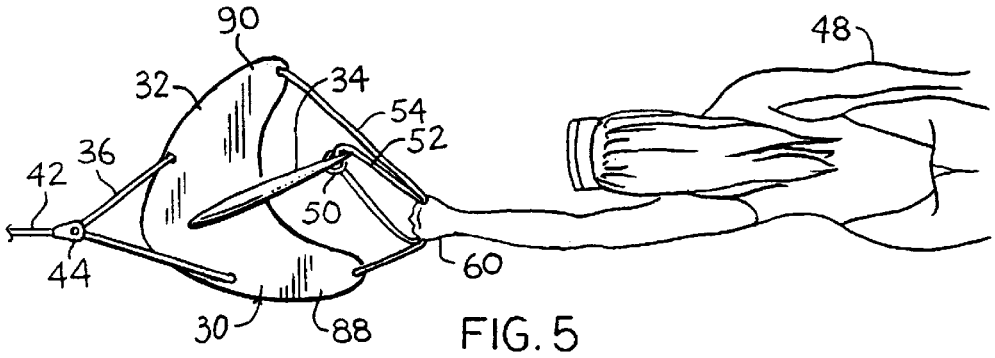
FIG. 5 is a top view of the present invention being controlled by the tethers showing a left turn attitude.

FIG. 5 illustrates the user 48 holding the horizontal tether 54 closer to the left side 88 than the right side 90 of the dive plane 32. This causes the fin 34 to establish an angle with respect to the tow rope 42. The ease with which this angle is achieved is assisted by the bridle 36 running through the pulley 44. If the bridle 36 was a rigid circular bridle connected by hinges (not shown) to the dive plane 32, the pulley 44 would never affect the force required to establish an angle of the fin 34. However, even though such an stiff bridle embodiment is possible, as shown in FIG. 5, the bridle 36 is flexible and the pulley 44 will subscribe a portion of an ellipse, which with increasing angles requires additional force be maintain with increasing angles, to assist the user 48 from over-controlling the device 30 in yaw.

Figure 6:
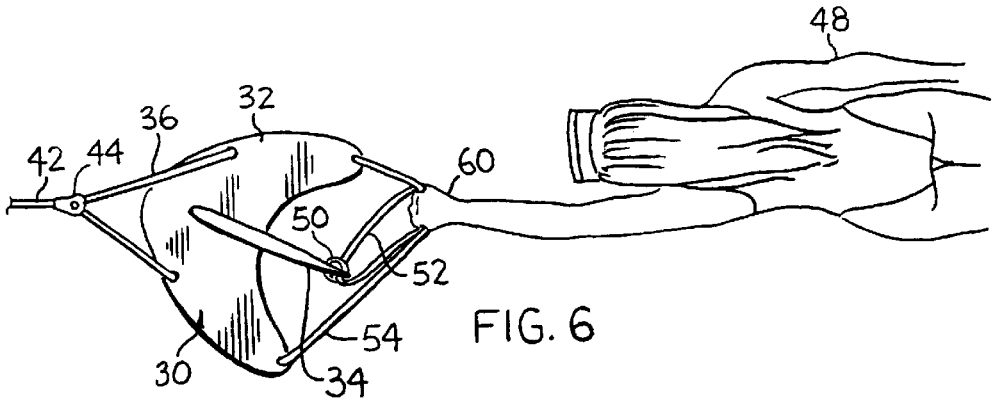
FIG. 6 is a top view of the present invention being controlled by the tethers showing a right turn attitude.

As shown in FIG. 6, the diver's hand 60 is holding onto the horizontal tether 54 closer to the right side 90 than the left 88. Therefore, the fin 34 guides the user 48 to the right.

Figure 7:
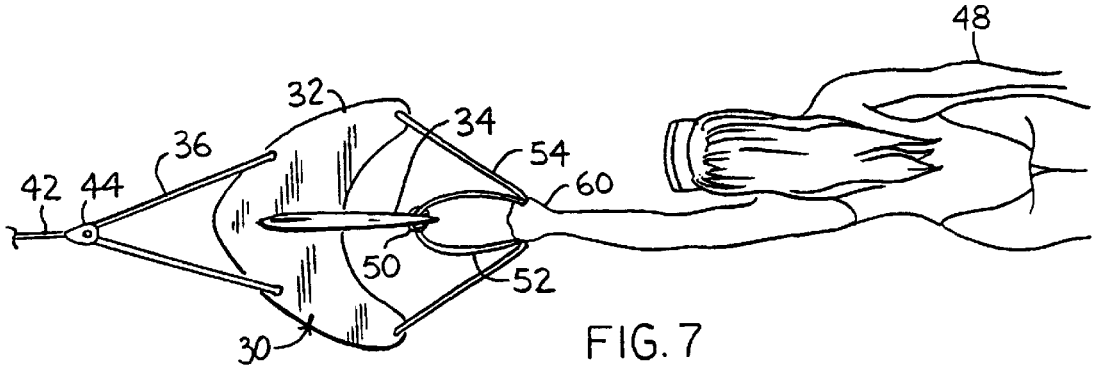
FIG. 7 is a top view of the present invention being controlled by the tethers showing a straight ahead attitude.

In FIG. 7, the user 48 is holding onto the horizontal tether 54 so his hand 60 is equally spaced from the left and right sides 88 and 90 of the dive plane 32. Therefore, the device 30 will follow in the direction of the tow rope 42.

Figure 8:
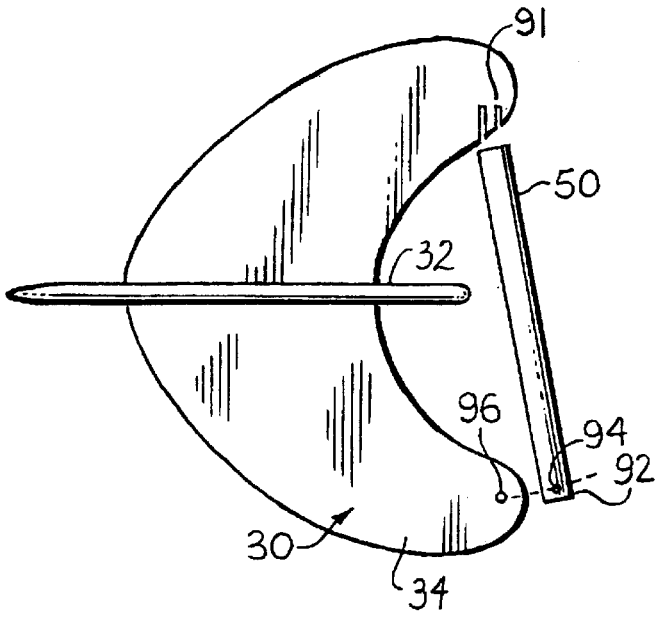
FIG. 8 is a side view of a tubular rigid bar of the present invention being attached to the device.
Figure 9:
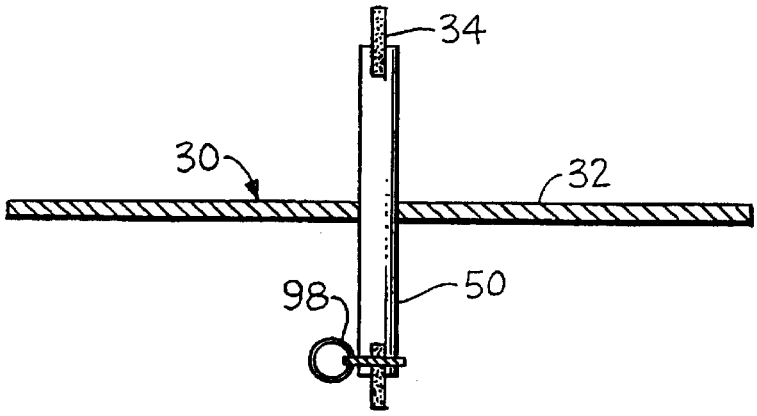
FIG. 9 is a partial cross-sectional view showing the tubular rig of FIG. 8 attached to the fin.

In some instances, the user 48 may prefer to hold on to the rigid bar 50 and obtain elevation changes by shifting his hand up and down the rigid bar 50, using the other hand to pull on the horizontal tether 54 to cause yaw movements from one side to the other. As shown in FIG. 8, the rigid bar 50 of device 30 is removable so that the fin 34 and the dive plane 32 can be taken apart and laid flat for storage. One way of attaching the rigid bar 50 to the fin 34 is to provide a hollow rigid bar and a pair of matching slots 91 in one portion of the fin 34 and a clevis 92 on the opposite end of the rigid bar 50 through which fits the lower fin portion 76. Holes 94 in the rigid bar 50 and a hole 96 in the fin 34 register when the bar 50 is in proper position. Then, as shown in FIG. 9, a retaining pin 98 can be inserted through the holes 94 and 96 to retain the rigid bar 50 the fin 34. It should be noted that the body attitude of the user 48 and the way the user's body and swim fins 53 (if worn) are disposed also greatly affect maneuvering. Neither horizontal directional control nor vertical directional control require substantial arm or body strength when the bar 50 or tethers 52 and 54 are utilized, for it is the user's drag which provides the force to articulate the planes. Indeed, experiment has shown there is no noticeable difference in effort between riding in a straight line and diving or turning. The user 48 feels only the force of his own drag 78, which only varies with changes of speed through the water.

Figure 10:
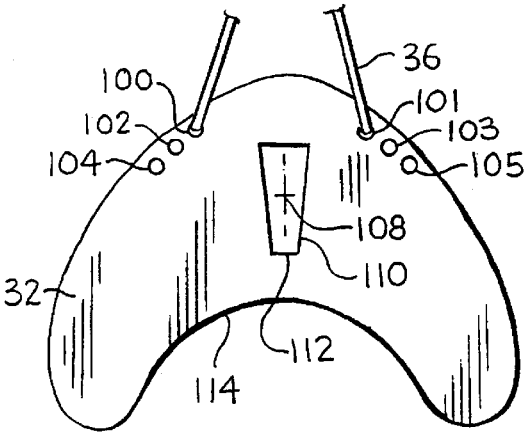
FIG. 10 is a top view of the dive plane of the present invention showing pairs of alternate bridle attachment points and a tapered slot in which the fin is attached.

As shown in FIG. 10, the dive plane 32 includes pairs of attach points 100 and 101, 102 and 103, and 104 and 105. The distance between each hole of a pair is not particularly important, but their spacing, fore and aft, is. When the bridle 36 is connected to the front holes 100 and 101, the dive plane 32 is relatively stable as its center of lift 108 is relatively far behind the holes 100 and 101. However, as the bridle 36 is moved to attach points that are closer to the center of lift 108, the dive plane 32 becomes less stable allowing the user 48 to change elevation or change rate of elevation change much more quickly. The dive plane 32 also includes a wedge opening 110 essentially centered therein which has a truncated apex 112 toward the rear 114 thereof.

Figure 12:
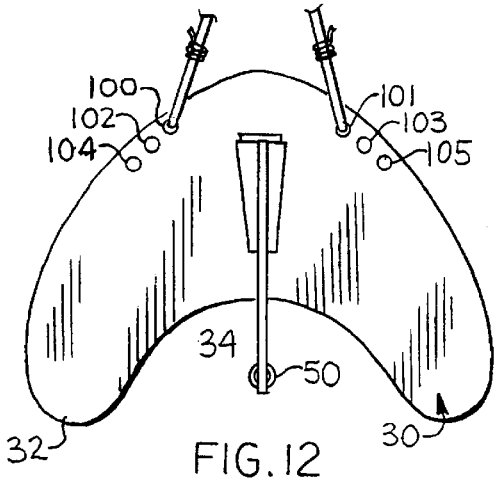
FIG. 12 is a top view showing how the dive plane and fin engage and lock.
Figure 11:
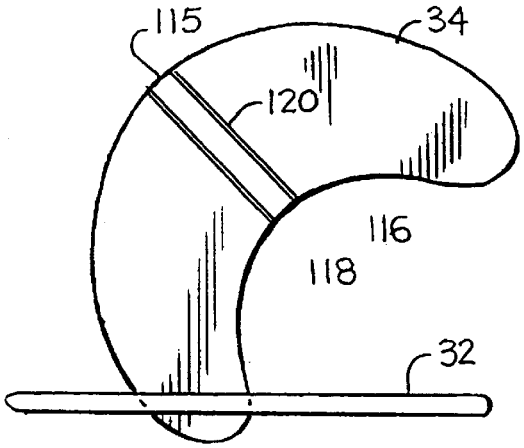
FIG. 11 is a side view showing the fin being inserted in the tapered slot.
Figure 13:
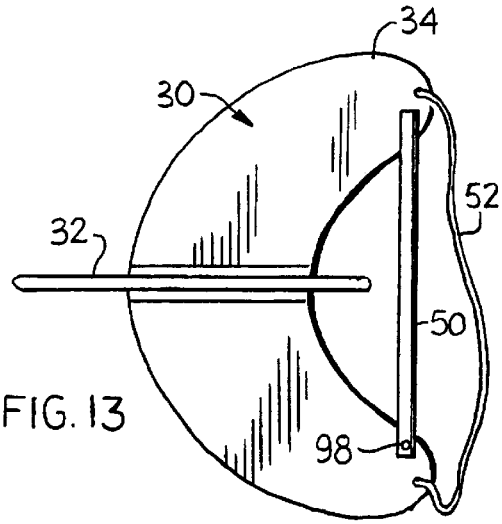
FIG. 13 is a side view showing how the dive plane and fin engage and lock.

As shown in FIG. 11, the fin 34 includes a wedge shaped girdle 115 about its middle 116 formed as a grove 118 in an attachment member 120. The fin 34, without its rigid bar 50 and its tether 52, is inserted through the wedge-shaped opening 110 as shown and is initially positioned forward in the opening 110. The fin 34 is then forced backwardly into the opening 110 as shown in FIGS. 12 and 13, which jams the fin 34 and the dive plane 32 together. Thereafter, the rigid bar 50 and the vertical tether 52 are attached to complete the assembly. When it is desired to disassemble the device 30, the opposite actions are performed. Note that the force from the bridle 36 and the drag 78 of the user 48 through the tether 52 or the rigid bar 50 act through the attachment member 120 between the dive plane 32 and the fin 34 to retain them in locked proper position.

Figure 14:
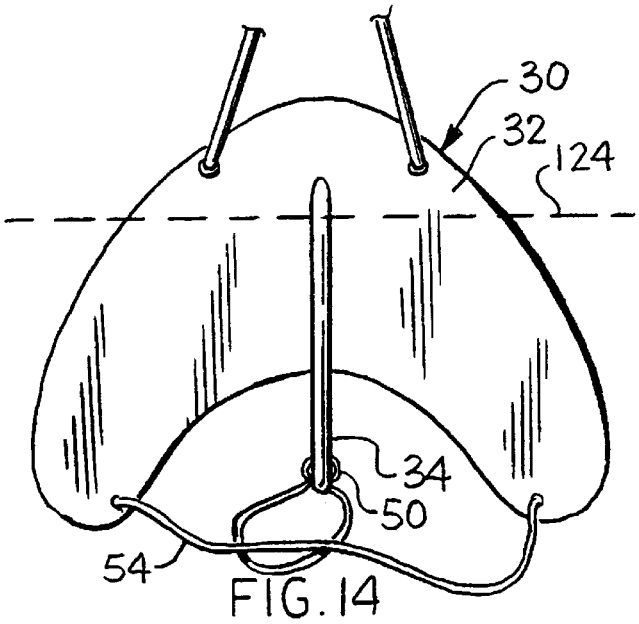
FIG. 14 is a top view illustrating the ratios of dive plane areas in relationship to the bridle attach points.
Figure 15:
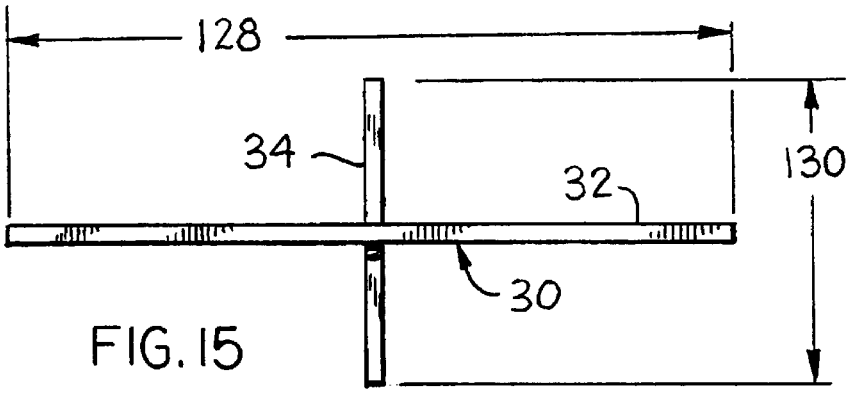
FIG. 15 is a top view illustrating preferred width to height ratios.
Figure 16:
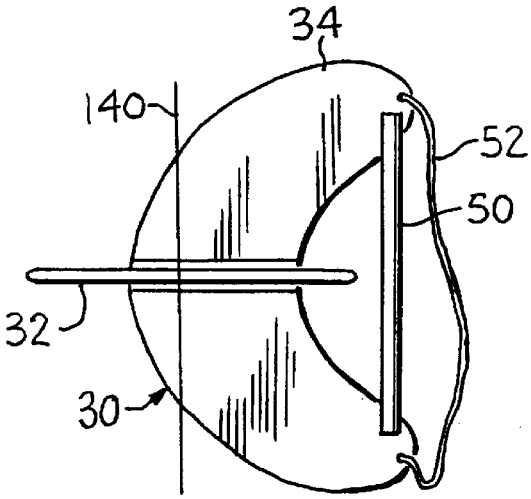
FIG. 16 is a side view illustrating preferred fin ratios and leash lengths.

FIG. 14 is a diagrammatic view showing how the axis of dive rotation 124 is established by location of the tow bridle attachment points 100 and 101, 102 and 103, and 104 and 105 to the dive plane 32. Preferably the ratio of surface area of the dive plane 32 forward of the axis of dive rotation 124 should fall in the range of 1:5 for a low performance up to 1 to 2:5 for high performance. Typical total surface areas of the dive plane 32 should be in the range of two square feet for a person of slight buoyancy up to four square feet for large buoyant riders or pairs of normal riders wishing reasonable performance at low speed. As shown in FIG. 15, the width 128 of the dive plane 32 to the height 130 of the vertical fin 34 should be approximately a ratio of 1:2. As the height increases performance increases up to a ratio of about 1:1. A width of two feet is minimum for a small riders with widths up to 42 inches for slow speed tandem riders. As shown in FIG. 16, the axis of turn rotation 140 is also established by the location of the bridle attachment points 100 and 101, 102 and 103, and 104 and 105. Oversteer characteristics begin to developing as more than twenty percent of the surface area of the vertical fin is forward of that axis. However, experienced riders desiring high performance can characteristically handle these oversteer characteristics. Leash loop lengths depend on the preference of the user with longer lengths being desirable for a higher performance for experienced riders.

Figure 17:
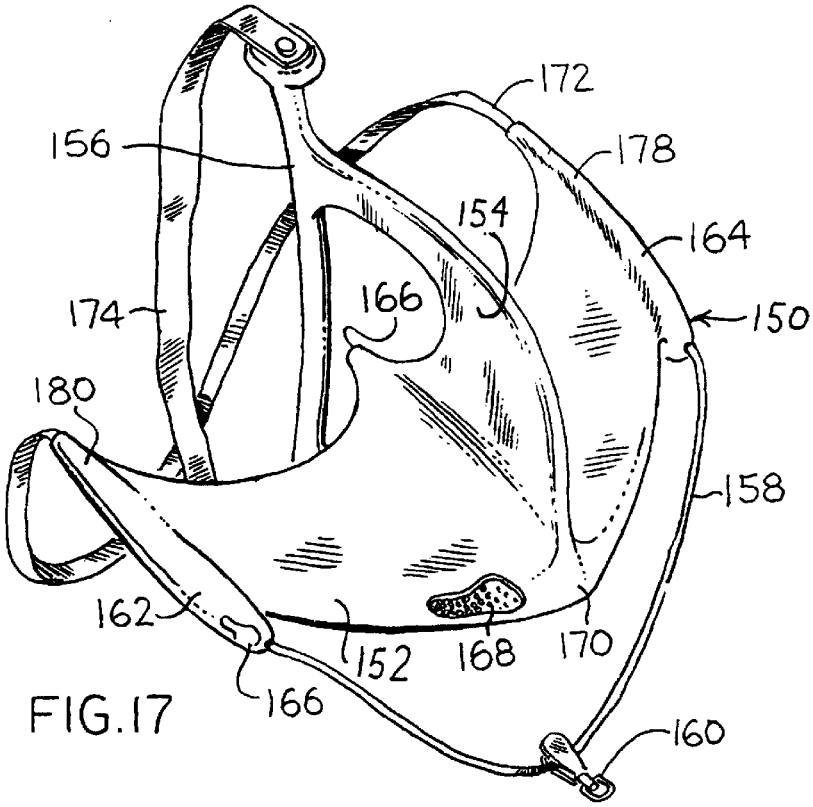
FIG. 17 is a perspective view of a modified embodiment of the present invention, where the dive plane and the fin are a unitary structure.

FIG. 17 shows a unitary hollow molded embodiment 150 of the present invention in which the dive plane 152 and the vertical fin 154 along with the rigid bar 156 are one piece. The bridle 158 with its tow line attaching pulley 160 are connected to the tips 162 and 164 of the dive plane 152. Note that holes 166 are used to allow flooding of the device 150 to achieve the desired buoyancy. Normally, foam or other buoyant material 168 is included in the forward portion 170 of the device 150 to assure that it will tend to surface when being towed after it has lost its user, either by a lost grip on the rigid bar 156 or on the horizontal and vertical tethers 172 and 174 attached to the device 150. The embodiment 150 is ideal for commercial attractions or rentals with the cost and complexity of having a breakdown device 30 are not warranted. The tips 162 and 164 of the dive plane 152 may include enlargements 178 and 180 which provide hand purchase to manually turn the device 150 and allowing the elimination of the horizontal tether 172 to reduce the parts count. Since the rigid bar 156 is present, the vertical tether can be eliminated as well.

Figure 18:
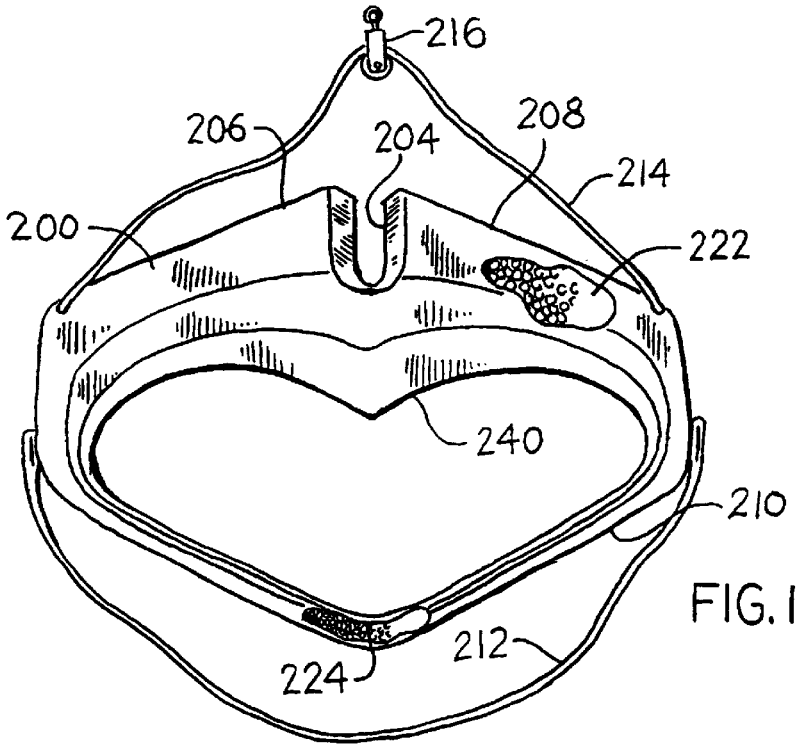
FIG. 18 is a side view of the fin of another modified embodiment of the invention that has been rotated 90° from normal.
Figure 19:
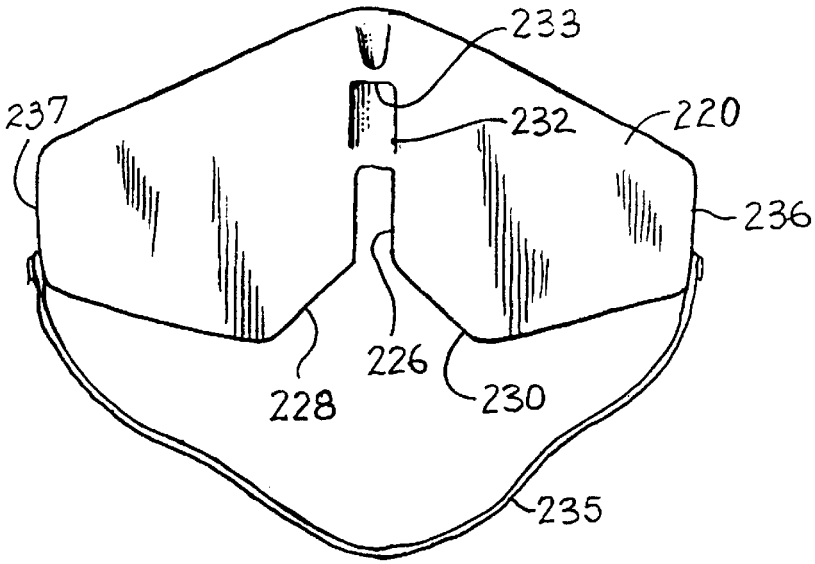
FIG. 19 is a top plan view of the dive plane of the embodiment of FIG. 18.
Figure 20:
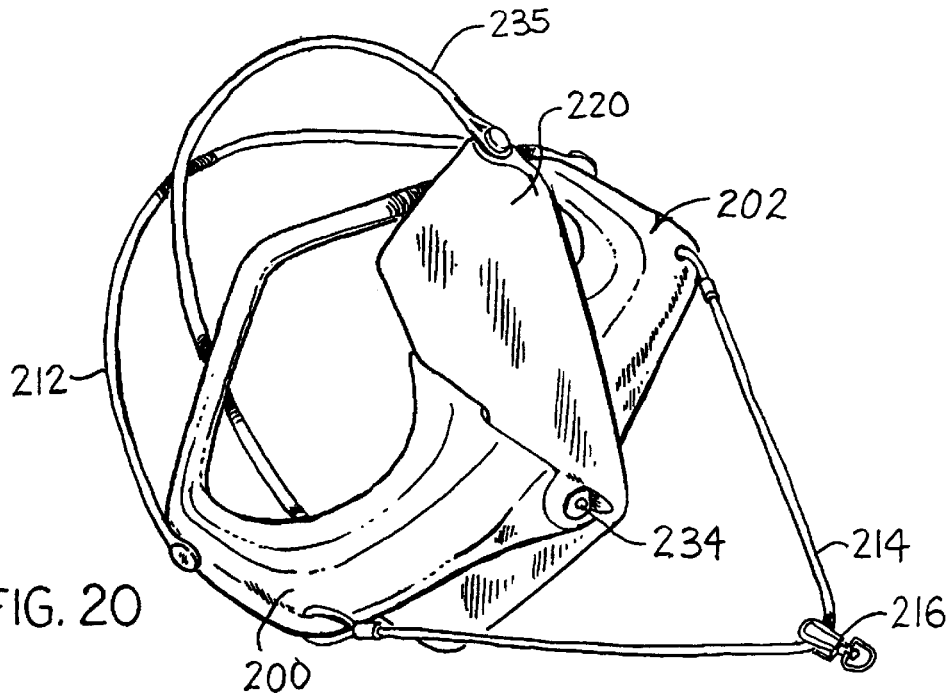
FIG. 20 is a perspective view showing the structures of FIGS. 18 and 19 assembled into the modified embodiment.

FIG. 18 shows the fin member 200 of a molded take apart embodiment 202, as shown the fin member 200 includes a slot 204 extending rearwardly from its leading edges 206 and 208 and the rigid bar 210 is also part of the unitary construction. A vertical tether 212 is connected at the opposite ends of the rigid bar 210. Note that in device 202, the bridle 214 with its pulley 216, is attached to the fin member 200, rather than the dive plane member 220 shown in FIG. 19. Since, in most instances, the primary forces applied to the device 202 by a user are through the rigid bar 210 or the vertical tether 212, this keeps all of the stresses within the fin member 200, which if hollow rotomolded, can be filled with foam 222 and weighted with shot 224 in its rigid bar 210 for strength and rigidity, and to produce the desired tendency to return to the surface under tow. The dive plane member 220 includes a slot 226 which extends from its trailing edges 228 and 230, a pair of channels 232 extending from and aligned with said slot 226 on both sides of the dive plane member 220, and a pair of abutment surfaces 233 at the ends of the channels 232 for engagement with the fin member 200 by means of its slot 204. To assemble the device 202, the fin member 200 and dive plane member 220 are slid together at the slots 204 and 226. Then fastener means such as screws 234 are usually used to retain the two components 200 and 220 together, as shown in FIG. 20. The horizontal tether 235 is connected at the tips 236 and 237 of the dive plane 220.

Figure 21:
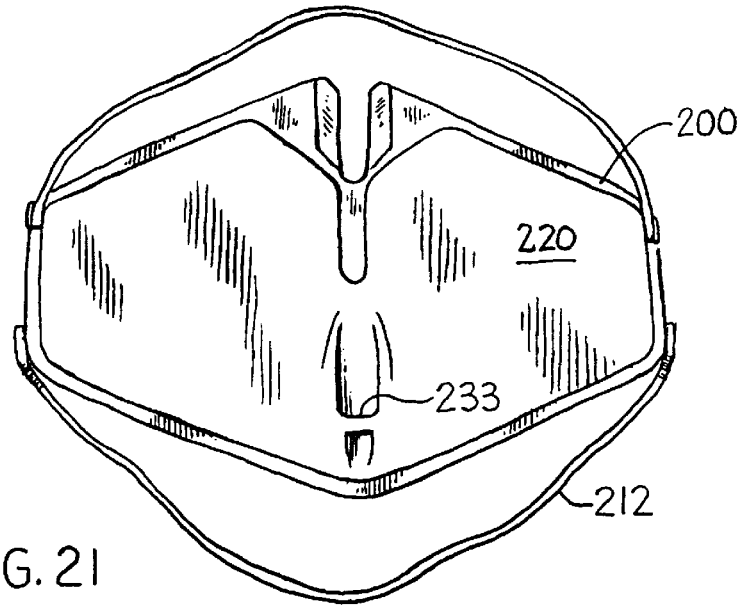
FIG. 21 is a top plan view showing how the fin and dive plane of FIGS. 18 and 19 nest for storage.

As shown in FIG. 20, the length of the tethers 212 and 235 are chosen so they meet at a single location 238 so that they can be gripped by one hand. The shape of the dive plane member 220 and the shape of the fin member 200 with its opening 240 to define the hand grip or rigid bar 210, are such that when laid flat together, the dive plane member 220 tends to nest into the fin member 200, as shown in FIG. 21 for flat storage or for insertion into a narrow net bag (not shown).

Figure 22:
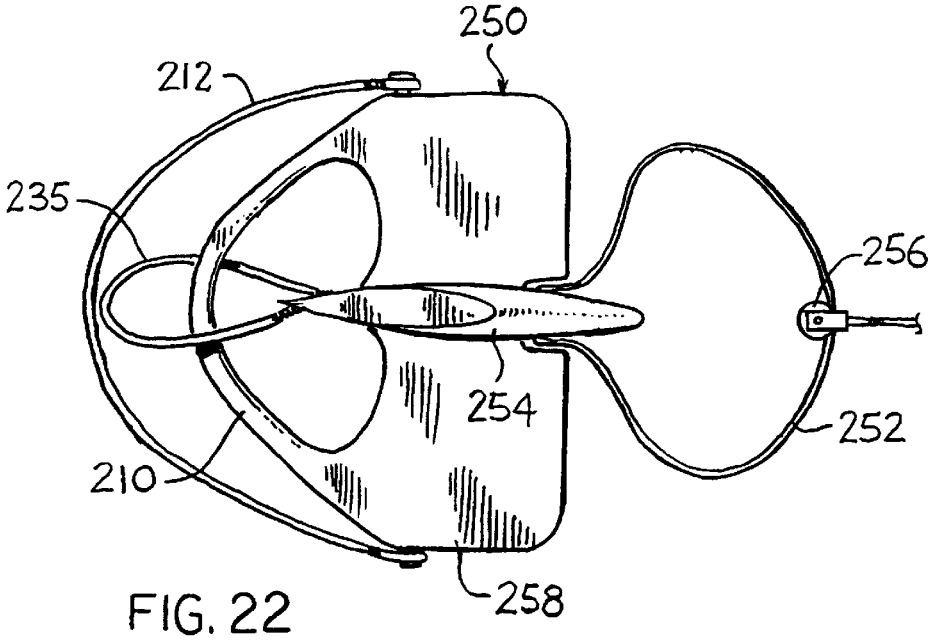
FIG. 22 is a side of a modified embodiment of that shown in FIG. 20.

The modified device 250 shown in FIG. 22 includes a rigid, semi-circular bail 252 hinged to the dive plane member 254 about which the pulley 256 travels. If the bail 252 is shaped into an ellipse, then the pulley 256 moves like it was attached to the flexible bridle 214. However other shapes can be used to change the forces required to establish a particular angle of the dive plane member 254.

Figure 23:
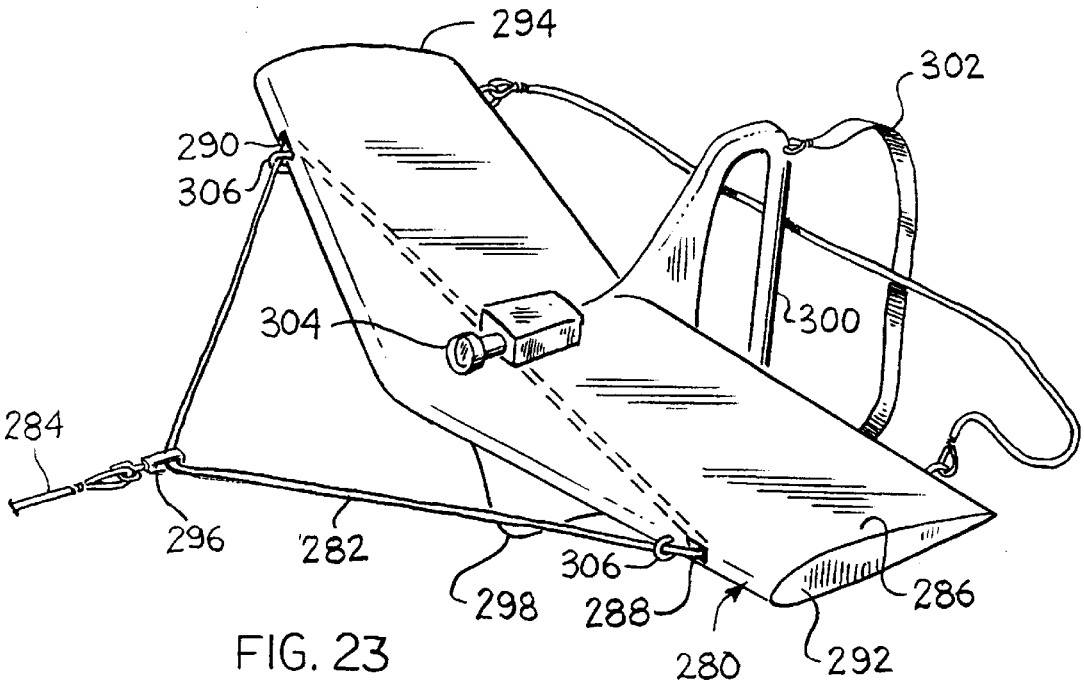
FIG. 23 is a perspective view of another modified embodiment of that shown in FIG. 20.

Another modified device 280 is shown in FIG. 23. In device 280, the bridle 282 is solidly connected to the tow line 284, but it acts like the bridle 214 because instead of being fixedly attached to the fin portion 286, it is formed in a loop which passes through a pair of cheek blocks 288 and 290 near the tips 292 and 294 of the dive plane member 286 so that the bridle 282 may slide back and forth within the dive plane member 286, acting just like the bridle 214 in shifting the position of the tow line connection 296 as the device 280 is maneuvered. The fin portion 298 extends downwardly but is not present above the dive plane member 286 except to form a support for a rigid handgrip 300 and a vertical tether 302. Therefore, a camera 304 can be mounted on the dive plane member 286 so that others can vicariously enjoy the underwater flight of the device 280. Although the camera 304 is shown above the dive plane member 286, if pictures of the bottom are desired, the device 280 would be rolled 180° so that the camera 304 becomes pointed downwardly and the view of the bottom is not blocked by the dive plane member 286. If a fixed off axis orientation of the device 280 is desired, the cheek blocks 288 and 290 can be those that include line stops 306 so that the bridle 282 can be fixed therein with the tow line connection 296 at an offset position.

Thus, there has been shown and described novel underwater maneuvering devices which fulfill all of the objects and advantages sought therefor. Many changes, alterations, modifications, and other uses and applications of the subject invention will become apparent to those skilled in the art after considering the specification together with the accompanying drawings and claims. All such changes, alterations and modification which do not depart from the spirit and scope of the invention are deemed to be covered by the invention which is limited only by the claims that follow.

What is claimed is:

1. An aquatic maneuvering device comprising:

a first fin member having:

a center; and at least first and second leading edges extending outwardly from said center;

a second fin member extending outwardly from and centered on said first fin member and positioned generally at a right angle thereto, said second fin member including:

a first portion extending from said first fin member; and a second portion extending from said first fin member opposite said first portion; and a hand grip extending between said first and second portions of said second fin member and positioned behind said first fin member.

2. The aquatic maneuvering device as defined in claim 1 further including:

a first flexible line forming a first steering semi-loop and connected to said first fin member at locations oppositely spaced from said center.

3. The aquatic maneuvering device as defined in claim 1 wherein said first fin member also includes:

at least first and second trailing edges, said device further including:

a first flexible line forming a first steering semi-loop and connected to said first fin member at locations adjacent said trailing edges equally spaced from said center.

4. The aquatic maneuvering device as defined in claim 3 wherein said second fin member also includes:

at least first and second trailing edges, said device further including:

a second flexible line forming a second steering semi-loop and connected to said second fin member at locations adjacent said trailing edges equally spaced from said center, said second steering semi-loop being generally at right angles to said first steering semi-loop, and in use trailing about the same distance back as said first steering semi-loop.

5. The aquatic maneuvering device as defined in claim 1 further including:

flotation means in said first fin member generally forward of the locations of bridle attachment, whereby said device, when uncontrolled, tends to self guide to the surface of the water in which it is positioned.

6. The aquatic maneuvering device as defined in claim 1 further including:

flotation means in said second fin member generally forward therein and weights generally aft of said flotation means, whereby said device, when uncontrolled, tends to self guide to the surface of the water in which it is positioned whether said device is being towed or not.

7. The aquatic maneuvering device as defined in claim 1 wherein said first fin member also includes:

at least first and second trailing edges which extend rearwardly as they extend outwardly and wherein said hand grip includes:

a rigid member extending between said first and second portions of said second fin member at said first and second trailing edges.

8. The aquatic maneuvering device as defined in claim 1 wherein said second fin member also includes:

a surface area;

first and second trailing edges which extend rearwardly and outwardly from said first fin member, said first trailing edge including:

a pair of slots facing said first fin member, and said second trailing edge including:

releasable attachment device, and wherein said hand grip includes:

a rigid member having:

a first end extending into said pair of slots; and a second opposite end adapted for releasable engagement by said releasable attachment device to said second fin member, said first fin member having:

an area that is at least about half more than said area of said second fin member.

9. The aquatic maneuvering device as defined in claim 8 wherein said first fin member also includes:

a first centrally located wedge shaped opening, and wherein second fin member also includes:

a trailing edge; and a centrally located wedge, whereby said first and second fin members are disassemblable and are connected together when said wedge is forced back into said wedge shaped opening, and wherein said bridle is attached to said first fin member so that forward force on said bridle when said device is being towed and rearward force applied to said rigid member by the drag of the user maintains said wedge and wedge shaped opening in engagement.

10. The aquatic maneuvering device as defined in claim 1 wherein said first fin member and second fin member are a unitary structure and hollow molded, said first fin member including:

first flotation means positioned generally forward therein, the device further including:

water entry means to allow said device to internally flood, whereby said device, when uncontrolled, tends to self guide to the surface of the water in which it is positioned.

11. The aquatic maneuvering device as defined in claim 1 wherein said first fin member also includes:

a trailing edge;

a centrally positioned slot extending from said trailing edge, and wherein second fin member also includes:

a leading edge; and a centrally located slot extending from said leading edge, whereby said first and second fin members are disassemblable and are connected by said slots being engaged with each other, and wherein said bridle is attached to said second fin member so that stresses created by the forward force on said bridle when said device is being towed and the rearward force applied to said device by the drag of the user remain in said second fin member.

12. The aquatic maneuvering device as defined in claim 1 wherein said second fin member includes:

at least third and fourth leading edges extending outwardly and rearwardly from said first fin member, and wherein said first and second leading edges extend rearwardly, whereby said first, second, third, and fourth leading edges tend to slide over any obstructions in their paths.

13. The aquatic maneuvering device as defined in claim 1 wherein said first fin member also includes:

first and second end tips, said device further including:

a first flexible line forming a first steering semi-loop and connected to said first fin member at said first and second end tips.

14. The aquatic maneuvering device as defined in claim 13 wherein said second fin member also includes:

first and second end tips, said device further including:

a second flexible line forming a second steering semi-loop and connected to said second fin member at said first and second end tips, said second steering semi-loop being generally at right angles to said first steering semi-loop, and in use trailing about the same distance back as said first steering semi-loop.

15. An aquatic device for maneuvering a person underwater comprising:

a dive plane member having:

a front;

a center of lift;

a left side;

a right side;

a center between said left and right sides extending from said front; and a leading edge extending outwardly and backwardly from said center along said left and right sides;

a fin member extending outwardly from and centered on said dive plane member and positioned generally at a right angle thereto, said fin member including:

a first portion extending outwardly from said dive plane member; and a second portion extending outwardly from said dive plane member opposite said first portion;

a first hand grip extending between said first and second portions of said fin member; and a second hand grip connected between said left and right sides, said second hand grip including:

a flexible line formed in a semi-loop.

16. The aquatic device as defined in claim 15 further including:

a tow bridle attached to said leading edge, spaced from said center, said tow bridle including:

friction reducing means about said tow bridle forward of said dive plane member for connection to a tow line; and a braided tow line connected to said friction reducing means, whereby said braided tow line does not tend to rotate said friction reducing means under different load conditions.

17. The aquatic device as defined in claim 15 further including:

pairs of tow bridle connection means, each pair of tow bridle connection means being equally spaced from said center and at different front to back distances from said center of lift, whereby the stability of said device in pitch of said dive plane member can be changed.

18. The aquatic device as defined in claim 15 further including:

a bridle attached at equally spaced locations from said center to said dive plane; and a traveling pulley for connection to a tow line attached about said bridle so said bridle can run there through, whereby said traveling pulley provides a low friction connection between said bridle and a tow line.

19. The aquatic device as defined in claim 15 further including:

a bridle attached to said fin member at equally spaced locations from said center; and a traveling pulley for connection to a tow line attached about said bridle so said bridle can run there through, whereby said traveling pulley provides a low friction connection between said bridle and a tow line.

20. The aquatic device as defined in claim 15 further including:

first flotation means in said dive plane member producing a floatation force ahead of said center of lift, whereby said device, when uncontrolled, tends to self guide to the surface of the water in which it is being towed.

21. The aquatic device as defined in claim 15 further including:

passive orientation means in said fin member to keep said fin member generally vertical when said device is uncontrolled and being towed.

22. The aquatic device as defined in claim 15 wherein said first hand grip is rigid, said dive plane member also including:

a third hand grip positioned between said first and second portions of said fin member and extending in a semi-loop behind said first hand grip, said second and third hand grips extending rearwardly about the same distance.

23. The aquatic device as defined in claim 15 wherein said fin member also includes:

first and second trailing edges which generally extend rearwardly as they extend outwardly; and a centrally located wedge, wherein said first hand grip includes:

a rigid member extending between said first and second portions of said fin member at said first and second trailing edges; and releasable attachment means retaining said rigid member to said first and second portions, and said dive plane member further including:

tow line attachment means; and a first centrally located wedge shaped opening shaped and sized to engage said centrally located wedge, whereby said dive plane member and said fin member are disassemblable and are connected by said centrally located wedge being forced back into said wedge shaped opening when force is applied through said tow line attachment means.

24. The aquatic device as defined in claim 15 wherein said fin member also includes:

tow line attachment means;

first and second trailing edges which generally extend rearwardly as they extend outwardly; and a centrally located forward facing slot, and said dive plane member further including:

a centrally located rearward facing slot, shaped and sized to engage said centrally located forward facing slot, whereby said dive plane member and said fin member are disassemblable and are connected by sliding said centrally located forward facing slot and said centrally located forward facing slot together.

25. The aquatic device as defined in claim 15 wherein said dive plane member includes:

water entry means to allow said dive plane member to internally flood, and said fin member includes:

structural foam therein to stiffen said fin member and to provide positive buoyancy to said device.

26. The aquatic device as defined in claim 25 further including:

a tow bridle attached to said fin member, spaced from said center and forward of said center of lift, said tow bridle including:

friction reducing means about said tow bridle forward of said dive plane member and said fin member for connection to a tow line, whereby forces applied to said fin member by said tow bridle can be transferred to the person holding said first hand grip without passing through said dive plane.

27. The aquatic device as defined in claim 15 wherein said dive plane member and said fin member are a unitary structure that is hollow molded, said device including:

water entry means to allow said device to internally flood, and said dive plane member includes:

flotation means positioned to provide floatation forward of said center of lift, whereby said device, when uncontrolled, tends to self guide to the surface of the water in which it is being towed.

28. An aquatic device for towing a maneuvering user underwater comprising:

a first fin member having:

first and second opposite ends;

a second fin member extending outwardly from and centered on said first fin member and positioned generally at a right angle thereto, said second fin member including:

a first portion extending from said first tin member; and a second portion extending from said first fin member opposite said first portion;

a hand grip positioned behind said first fin member and extending between said first and second portions of said second fin member; and a tow bridle attached to one of said fin members at spaced locations from the other of said fin members.

29. The aquatic device as defined in claim 28 further including:

a first flexible line forming a first steering semi-loop and connected to said first fin member at spaced locations from said second fin member.

30. The aquatic device as defined in claim 28 further including:

a first flexible line forming a first steering semi-loop and connected to said first fin member at spaced locations from the said second fin member.

31. The aquatic device as defined in claim 30 further including:

a second flexible line forming a second steering semi-loop and connected to said second fin member at spaced locations from the said first fin member, said second steering semi-loop being generally at right angles to said first steering semi-loop, and in use trailing in the water about the same distance as said first steering semi-loop.

32. The aquatic device as defined in claim 28 wherein said first and second portions of said second fin member extend rearwardly, and said hand grip is a rigid member extending between said first and second portions of said second fin member.

33. The aquatic device as defined in claim 32 wherein said second fin member also includes:

releasable attachment means for said rigid member.

34. The aquatic device as defined in claim 33 wherein said first fin member also includes:

a wedge shaped opening between said first and second opposite ends, and wherein second fin member also includes:

a wedge portion between said first and second portions thereof, whereby said first and second fin members are disassemblable and are connected by said wedge portion being forced back into said wedge shaped opening, and wherein said tow bridle is attached to said first fin member so that when said device is being towed, forward force on said tow bridle and rearward force applied to said rigid member by the drag of the user maintains said first and second fin members in engagement.

35. The aquatic device as defined in claim 28 wherein said first fin member and second fin member are a unitary structure and hollow molded, said first fin member including:

flotation means positioned forward in the device, the device further including:

water entry means to allow said device to internally flood, whereby said device, when uncontrolled, tends to self guide to the surface of the water in which it is being towed.

36. The aquatic device as defined in claim 28 wherein said first fin member also includes:

a trailing edge;

a first slot extending from said trailing edge and positioned between said first and second opposite ends, and wherein second fin member also includes:

a leading edge; and a second slot extending from said leading edge, whereby said first and second fin members are disassemblable and are connected by said first and second slots being engaged with each other, and wherein said tow bridle is attached to said second fin member so that when said device is being towed, stresses caused by forward force on said bridle and rearward force applied to said device by the drag of the user remains in said second fin member.

37. The aquatic device as defined in claim 28 wherein said first fin member also includes:

a trailing edge;

a first slot extending from said trailing edge and positioned between said first and second opposite ends, and wherein second fin member also includes:

a leading edge; and a second slot extending from said leading edge, whereby said first and second fin members are disassemblable and are connected by said first and second slots being engaged with each other.

38. An aquatic device for towing a maneuvering user underwater comprising:

a first fin member having:

first and second opposite ends;

a second fin member extending outwardly from and centered on said first fin member and positioned generally at a right angle thereto, said second fin member including:

a first fin portion extending from said first fin member; and a second portion extending from said first fin member opposite said first fin portion;

a hand grip positioned behind said first fin member and attached between said first portion and said second portion of said second fin member, whereby one hand control is possible; and a tow bridle attached to one of said fin members at spaced locations from the other of said fin members.

39. The aquatic device as defined in claim 38 wherein said first fin member further includes:

friction reducing means connecting said tow bridle to and through said first fin member, said tow bridle being formed in a loop and including:

locking means to temporarily fix said tow bridle with respect to said low friction means to lock said aquatic device at a fixed steering angle.

* * * * *